US006328651B1

(12) United States Patent
Lebensfeld et al.

(10) Patent No.: US 6,328,651 B1
(45) Date of Patent: Dec. 11, 2001

(54) PROJECTED IMAGE TARGET SHOOTING TOY

(75) Inventors: Steven Lebensfeld, Laurel Hollow; Brian Waldman, New York, both of NY (US); Chan John Ping, Bridgewater, NJ (US); Paul Dowd, Bronxville, NY (US)

(73) Assignee: Toymax Inc., Plainview, NY (US)

( * ) Notice: Subject to any disclaimer, the term of this patent is extended or adjusted under 35 U.S.C. 154(b) by 0 days.

(21) Appl. No.: 09/243,912

(22) Filed: Feb. 3, 1999

(51) Int. Cl.[7] ..... A63F 9/02
(52) U.S. Cl. ..... 463/52; 463/51; 463/49
(58) Field of Search ..... 463/49, 50, 51, 463/52, 53, 54, 56, 57, 43, 44; 434/21, 22

(56) References Cited

U.S. PATENT DOCUMENTS

| | | | | |
|---|---|---|---|---|
| 2,042,174 | | 5/1936 | Foisy . | |
| 2,516,319 | | 7/1950 | Hooker . | |
| 2,569,594 | | 10/1951 | AAgesen . | |
| 2,593,117 | | 4/1952 | Davenport . | |
| 2,665,133 | | 1/1954 | Garrido . | |
| 2,689,130 | | 9/1954 | Henry . | |
| 2,995,834 | | 8/1961 | Rowe . | |
| 3,675,925 | | 7/1972 | Ryan et al. . | |
| 3,904,204 | * | 9/1975 | Yokoi | 273/101.1 |
| 3,918,714 | | 11/1975 | Ceccaroni . | |
| 3,990,704 | * | 11/1976 | Meyer et al. | 273/101.2 |
| 4,111,423 | | 9/1978 | DeWeese . | |
| 4,163,557 | | 8/1979 | McLellan . | |
| 4,175,748 | * | 11/1979 | Yokoi | 273/101.2 |
| 4,229,009 | * | 10/1980 | Ohta | 273/312 |
| 4,296,931 | * | 10/1981 | Yokoi | 273/316 |
| 4,322,080 | | 3/1982 | Pennington . | |
| 4,335,880 | * | 6/1982 | Meyer et al. | 273/310 |
| 4,898,391 | * | 2/1990 | Kelly et al. | 273/310 |
| 5,366,229 | | 11/1994 | Suzuki . | |
| 5,641,288 | * | 6/1997 | Zaenglein, Jr. | 434/21 |
| 5,649,706 | * | 7/1997 | Treat, Jr. et al. | 273/358 |
| 5,741,185 | * | 4/1998 | Kwan et al. | 463/51 |
| 5,984,788 | * | 11/1999 | Lebensfeld et al. | 463/51 |

OTHER PUBLICATIONS

"Electronic Toys & Games". Toymax. [retrieved from the Internet: Aug. 15, 2000] URL< http://www.toymax.com/toycentral/el/arcadia.html>.*

"CPSC, Toymax Inc. Announce Recall to Replace Skeet Shoot Game Cartridges." [retrived from the Internet: Aug. 15, 2000] URL <wysiwyg://20/http://www.esafety.com/esafety_cfmfiles/esafety.cfm/1517>.*

* cited by examiner

*Primary Examiner*—Jessica J. Harrison
*Assistant Examiner*—Julie Kasick
(74) *Attorney, Agent, or Firm*—Brown Raysman Millstein Felder & Steiner LLP

(57) ABSTRACT

A target shooting toy which optically projects an image of a target which can be aimed at and hit. The toy includes an image projector that projects an optical image onto a wall or screen and a toy gun which is aimed at the target. The toy detects hits by detecting light received by the gun reflected from the target. The toy has a removable electronics cartridge which has circuitry that customizes image motion, sequences and game play to the particular image being displayed. The toy also has a removable image module that contains the image or images of one type of target. The image modules and the electronics cartridges are matched so the toy may be used with many types of target images and yet be customized for use with each type of target. The projector is driven relative to two coordinates axes to provide more realistic motion and motion sequences. The toy gun has a pump action reload and trigger cocking mechanism, and provides a simulated recoil when fired.

15 Claims, 10 Drawing Sheets

FIG. 12

| GAME | DESCRIPTION |
|---|---|
| -1 | STILL TARGET |
| -2 | HIDING STILL TARGET |
| -3 | SKEET |
| -4 | DUCK IN FLIGHT |
| -5 | STEALTH DUCK |

FIG. 13

| FUNCTION | # OF PLAYERS | SCORE | GAME END | SPEED |
|---|---|---|---|---|
| F1 Practice | 1-9 | None | 100Hits/5Min | Slow |
| F2 Practice | 1-9 | None | 110Hits/5Min | Fast |
| F3 Practice | 1-9 | None | 100Hits/5Min | Variable |
| F4 Beginner | 1-9 | Each Hit = 1 point | 4 Minutes | Slow |
| F5 Intermediate | 1-9 | Each Hit = 1 point | 4 Minutes | Medium |
| F6 Expert | 1-9 | Each Hit = 1 point | 4 Minutes | Fast |
| F7 Variable | 1-9 | Each Hit = 1 point | 4 Minutes | Variable |
| F8 Challenge | 1-9 | Each Hit = 1 point | 10 Missed Shots | Variable |
| F9 Head to Head | 2 ONLY | P1= Player 1 Hit<br>P2 = Player 2 Hit | First player to<br>Hit 10 targets | Variable |

FIG. 14

| PLAYERS | DESCRIPTION |
|---|---|
| P1 | 1 Player Only |
| P2 | 2 players -1 after the other |
| P3 | 3 players -1 after the other |
| P4 | 4 players -1 after the other |
| P5 | 5 players -1 after the other |
| P6 | 6 players -1 after the other |
| P7 | 7 players -1 after the other |
| P8 | 8 players -1 after the other |
| P9 | 9 players -1 after the other |
| 2P | 2 Players Head to Head Challenge |

PROJECTED IMAGE TARGET SHOOTING TOY

BACKGROUND OF THE INVENTION

The invention disclosed herein relates to a target shooting toy or game, and more particularly to a target shooting toy that simulates shooting at and hitting a target, particularly a moving target (e.g. skeet, duck or other moving or flying animals, airplanes, vehicles and other moving objects, etc.). More particularly, the invention relates to such a target shooting toy which displays an optical image, e.g., by projecting it to a display surface, and which determines using optics and electronics when a target image has been "hit" by a toy gun that can be aimed at the image.

There is a continuing need to produce and provide toys and amusement devices that have a high play value. With respect to target shooting toys, they should also challenge, stimulate and retain the attention of one or more players. To provide lasting play value, a target shooting toy should accommodate varying skill levels to allow players to compete at different levels and to improve their skills with continued play (e.g. co-ordination, reflexes and the like). Also, such toys should be manufactured inexpensively for mass marketing.

Various toys, amusement devices and training devices are disclosed in the following U.S. Pat. No. 2,042,174 (Foisy, issued May 26, 1936); U.S. Pat. No. 2,516,319 (Hooker, issued Jul. 25, 1950); U.S. Pat. No. 2,593,117 (Davenport, issued Apr. 15, 1952); U.S. Pat. No. 2,569,594 (Aagesen, issued Oct. 2, 1951); U.S. Pat. No. 2,665,13 (Garrido, issued May 5, 1954); U.S. Pat. No. 2,689,130 (Henry, issued Sep. 14, 1954); U.S. Pat. No. 2,995,834 (Rowe, issued Aug. 15, 1961); U.S. Pat. No. 3,918,714 (Ceccaroni, issued Nov. 11, 1975); U.S. Pat. No. 3,675,925 (Ryan et al, issued Jul. 11, 1972); U.S. Pat. No. 3,904,204 (Yokoi issued Sep. 9, 1975); U.S. Pat. No. 3,990,704 (Meyer et al, issued Nov. 9, 1976); U.S. Pat. No. 4,111,423 (De Weese, issued Sep. 5, 1978); U.S. Pat. No. 4,163,557 (Mc Lellan, issued Aug. 7, 1979); U.S. Pat. No. 4,175,748 (Yokoi, issued Nov. 27, 1979); U.S. Pat. No. 4,229,009 (Ohta, issued Oct. 21, 1980); U.S. Pat. No. 4,322,080 (Pennington, issued Mar. 30, 1982); U.S. Pat. No. 4,335,880 (Meyer et al, issued Jun. 22, 1982); and U.S. Pat. No. 5,366,229 (Suzuki, issued Nov. 22, 1994).

However, there remains a need for a target shooting toy that has one or more of the following: is relatively inexpensive and has high play; simulates target shooting games (e.g., skeet) with improved realism; is compact, can be easily set up; accommodates various skill levels; provides various types of target shooting games; is capable of single or multi-player use; provides various target images; provides improved and variable target motion; coordinates target motion with the type of target represented by the target image; provides overall versatility; provides realistic sound associated with various target images; provides competitive shooting games and practice; and other characteristics and features disclosed in the description and drawings herein. The invention herein provides a target shooting toy which has one or more of the features and characteristics described immediately above, and in one embodiment, provides all of the above features and characteristics.

SUMMARY OF THE INVENTION

It is an object of the invention disclosed herein to provide a target shooting toy which has one or more of the above described features and characteristics, particularly a target shooting toy which can be manufactured inexpensively.

The invention disclosed herein realizes certain of the features and characteristics described above in a toy which has the capability of displaying different images while providing motion, sound, and/or display sequences and/or other attributes which differ at least partially from image to image. Thus, motion and other attributes may be more closely matched with the type of target to be displayed by the toy. This may be accomplished in accordance with the invention by permanently associating with the toy that structure which is commonly used by the toy to display and move all images, or to provide audio for all images, etc., and providing in one or more user replaceable modules the remaining structure which defines and/or controls the display, motion and/or sound characteristics and/or sequences specific to one or certain images. The replaceable modules may contain electronics only, optics only, or both.

For example, images may be optically projected onto a display surface, and the replaceable module may contain electronics which causes the image to be electronically generated, and electronics which defines and/or controls the projection, display and movement of the image. In that case, the images are electronically stored. In another embodiment, the images may be optically stored in an optical format, e.g., on an optical medium such as on a film transparency, and a replaceable image module may be provided for the different stored images. One or more electronics modules may also be provided to cooperate with the image modules to define and/or control image display, projection and movement, and audio accompaniment.

In the preferred embodiment, the images are optically projected onto a display surface, and motion is imparted to the projected image(s) by mechanically coupling one or more electric motors to a structure which projects a light beam defining the optical image(s). A replaceable electronics module defines the motion parameters and/or sequences by which the motor or motors are driven, and provides control signals to a circuit or circuits not part of the electronics module which drive the motor(s). Depending upon the embodiment, the electronics module can also define and/or control sound and image display, e.g., changes in the image itself (e.g., from flying to falling, or from intact to broken-up, etc.), or displaying the image only at predetermined times in a sequence or after an event or since a predetermined time, or for predetermined periods of time, etc.

As mentioned, the images may be stored in an optical format, on an optical medium such as a film transparency, or electronically, such as in memory, and displayed on a display device. The optical format image or the image in the display device is projected by a light beam as an optical image onto a display surface. Where the images are stored in an optical format, they may be provided as replaceable modules which include one or more film transparencies or equivalent. Where the images are stored electronically, they may be provided with the replaceable electronics module or as another replaceable electronics module.

According to one embodiment, the target shooting toy includes an image projector that projects a light beam therefrom that defines an image upon impinging a display surface, a drive system for the image projector which moves the light beam, a light detector which provides electrical signals in response to light received by the light detector, a hit determining electrical circuit coupled to the light detector which determines a hit from the electrical signals provided by the light detector when light received by the light detector is reflected from an image projected by the image projector on the display surface, and a user movable device which when pointed at the display surface directs light from the display surface to the light detector. In this embodiment, the drive system moves the light beam to project an image which moves relative to at least two coordinate axes and includes at least one electrical motor carried by the housing coupled to the image projector, a first electrical circuit carried by the housing coupled to the at least one motor, and a second electrical circuit having motion-defining parameters which define the motion of the light beam from the image projector. At least one connector having a one part connected to the second circuit is removably connectable to another part connected to the image projector to removably couple the second electrical circuit to the first electrical circuit such that the second electrical circuit can be removed and replaced by another second electrical circuit having motion-defining parameters different from those of the second electrical circuit. The first and second electrical circuits cooperate to supply electrical power to the at least one motor in accordance with the motion-defining parameters of the second electrical circuit.

The motion-defining parameters of the second electrical circuit may define at least seemingly unpredictable motion of the light beam and/or varying speed motion of the light beam. The second electrical circuit may have first and second motion-defining parameters and be responsive to the hit detecting circuit defines the motion of the light beam in accordance with the first motion-defining parameters when no hit is detected and in accordance with the second motion-defining parameters when a hit is detected.

In one embodiment, the second electrical circuit includes a memory storing at least some of the motion-defining parameters and logic circuitry responsive to the memory which controls the first electrical circuit, or a programmed processor (computer). The programmed processor or computer constitutes the second electrical circuit and the hit determining circuit, and may include the memory storing at least some of the first and second motion-defining parameters.

The second electrical circuit may have a plurality of sets of motion-defining parameters, and a selector may be coupled to the second electrical circuit which is responsive to the selector to select a set of motion-defining parameters. The hit-determining circuit may be coupled to the at least one connector and may be removable as a unit with the second electrical circuit. The toy may comprise a display coupled to the second circuit which is controlled thereby to display the number of hits determined by the hit determining circuit, or other information.

In another embodiment, the second electrical circuit has parameters which define at least one attribute of the light beam projected from the image projector and can be removed and replaced by another second electrical circuit which defines the at least one parameter of the light beam differently from that of the second electrical circuit, whereby use of different second electrical circuits enables the target shooting toy to provide different images with at least one different attribute determined by the particular second electrical circuit coupled to the first electrical circuit.

The target shooting toy can also include an image module having at least one image optically stored therein which can be projected by the light beam onto the display surface. The at least one image stored by the second circuit and the at least one parameter of the second circuit are related, and the image module and the second circuit each having indicia to identify them as a related pair.

The second electrical circuit is preferably mounted in the electronics module referred to above, and the first electrical circuit is non-removably mounted to the image projector.

In one embodiment, the drive system for the projector which moves the light beam to project an image on the display surface moves the light beam (or image) relative to at least two coordinate axes. In this embodiment, the toy includes a base and the drive system includes a turret supported by the base for rotation relative to a first coordinate axis, a first electric motor mounted to the base and coupled to the turret to selectively rotate the turret relative to the first coordinate axis, a support arm fixed to the turret to which the projector is mounted for rotation relative to a second coordinate axis, a second electric motor mounted to the base and a transmission extending at least partially within the support coupling the second electric motor to the projector to selectively rotate the projector relative to the second coordinate axis, whereby the projector can be moved relative to the two coordinate axes.

A toy gun for use with the image projector may comprise a trigger and a trigger cocking mechanism which operates to cock the trigger, without which the gun can not be "fired". The toy gun includes a trigger spring coupled to the trigger to urge the trigger to a home position. The trigger cocking mechanism comprises a manually engageable member mounted to the gun which is accessible at the exterior of the gun, and includes structure engageable by a user's hand which is movable relative to the gun. The trigger cocking mechanism also includes structure on the trigger and structure mounted to the gun which engage under action of the spring in response to motion of the manually engageable member to cock the trigger, and which disengage upon rotation of the trigger in the cocked condition thereof. A first electrical switch mounted to the gun is closed only when the trigger is cocked, and a second electrical switch mounted to the gun is closed when the trigger is pressed. The first and second electrical switches are coupled in an electrical circuit, e.g., in series, which is closed only when the trigger is pressed in the cocked condition of the trigger. The closing of the circuit may be detected to cause the circuitry to determine whether a hit has occurred, or to play sound effects, or to perform other functions.

In the preferred embodiment, the toy gun comprises a gun barrel and the manually engageable member comprises a handle mounted to the gun barrel to move therealong to simulate pump action reloading in a gun. In another embodiment, the manually engageable member may be pivotally mounted to the gun, for example as part of a trigger guard, to simulate lever action reloading of the gun. In the preferred embodiment, the cocking mechanism comprises a first slidable member mounted within the gun barrel coupled to the handle to be moved towards the trigger when the handle is moved towards the trigger, a spring coupled to the slidable member urging the slidable member towards the trigger, a first hook attached to the trigger and a second hook attached to the slidable member which engage in response to movement of the slidable member towards the trigger and release upon rotation of the trigger in the cocked condition thereof. The first switch is closed by tie slidable member in the cocked condition of the trigger.

The toy gun may simulate a recoil upon firing the gun. This may be implemented in the preferred embodiment by a second slidable member mounted within the gun barrel. The first and second slidable members each comprise a rack gear, a pinion gear rotatably mounted between the first and second slidable members meshing with the rack gears, with the above mentioned spring being coupled to the second slidable member to urge the second slidable member towards the trigger. This arrangement urges the first slidable member away from the trigger under action of the pinion gear and the rack gears, and a stop positioned along a path of travel of the second slidable member stops the motion of the second slidable member back towards the trigger while the spring exerts substantial force on the second slidable member to simulate a recoil when the trigger is pressed in its cocked condition.

The toy gun may include an electrical sound circuit coupled to the circuit closed by the first and second electrical switches which provides a gun firing sound signal in response a closing of that circuit, and/or a gun cocking sound in response to a closing of only one the switches when the circuit in which the first and second switches is connected is open.

BRIEF DESCRIPTION OF THE DRAWINGS

The invention is illustrated in the figures of the accompanying drawings which are meant to be exemplary and not limiting. The description herein, including the appended claims, identifies various details by specific names for convenience. These names are intended to be generic in their application while differentiating between the various details. Like or associated references in the different figures refer to like or corresponding parts. In the accompanying drawings:

FIG. 12 is a table with examples of options for a playing a game with the toy represented by FIGS. 1–11 and the corresponding codes that may be displayed on a display the image projector unit depicted in FIG. 2;

FIG. 13 is a table with an example of options of playing modes and the corresponding codes that may be displayed on the display depicted in FIG. 2; and FIG. 14 is table of examples of player options and the codes corresponding to the player options that may be displayed on the display depicted in FIG. 2.

DESCRIPTION OF THE PREFERRED EMBODIMENTS

Figure 2:
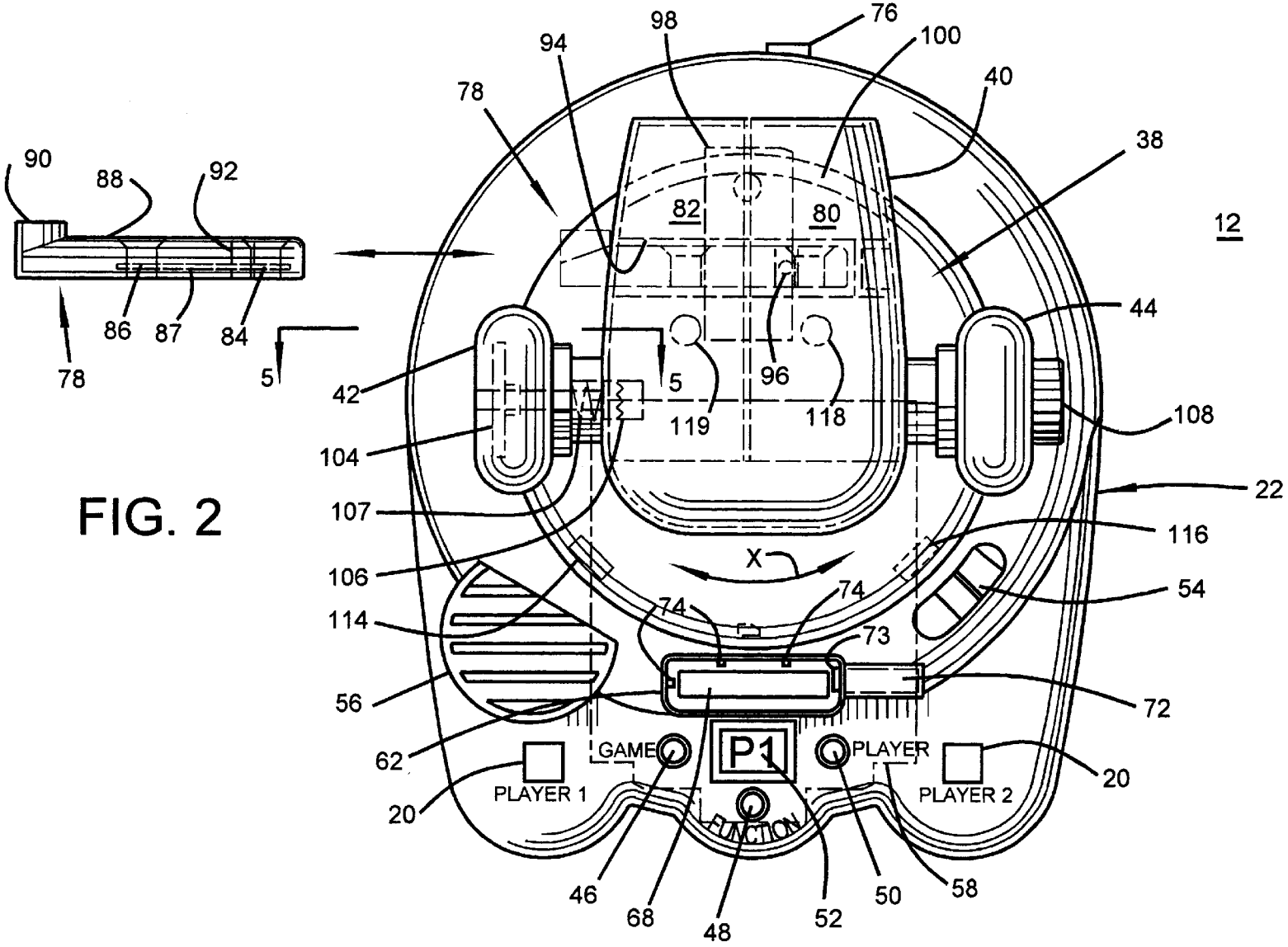
FIG. 2 is a top plan view of the image projector unit depicted in FIG. 1 showing an image module in solid lines removed from the image projector unit.
Figure 3:
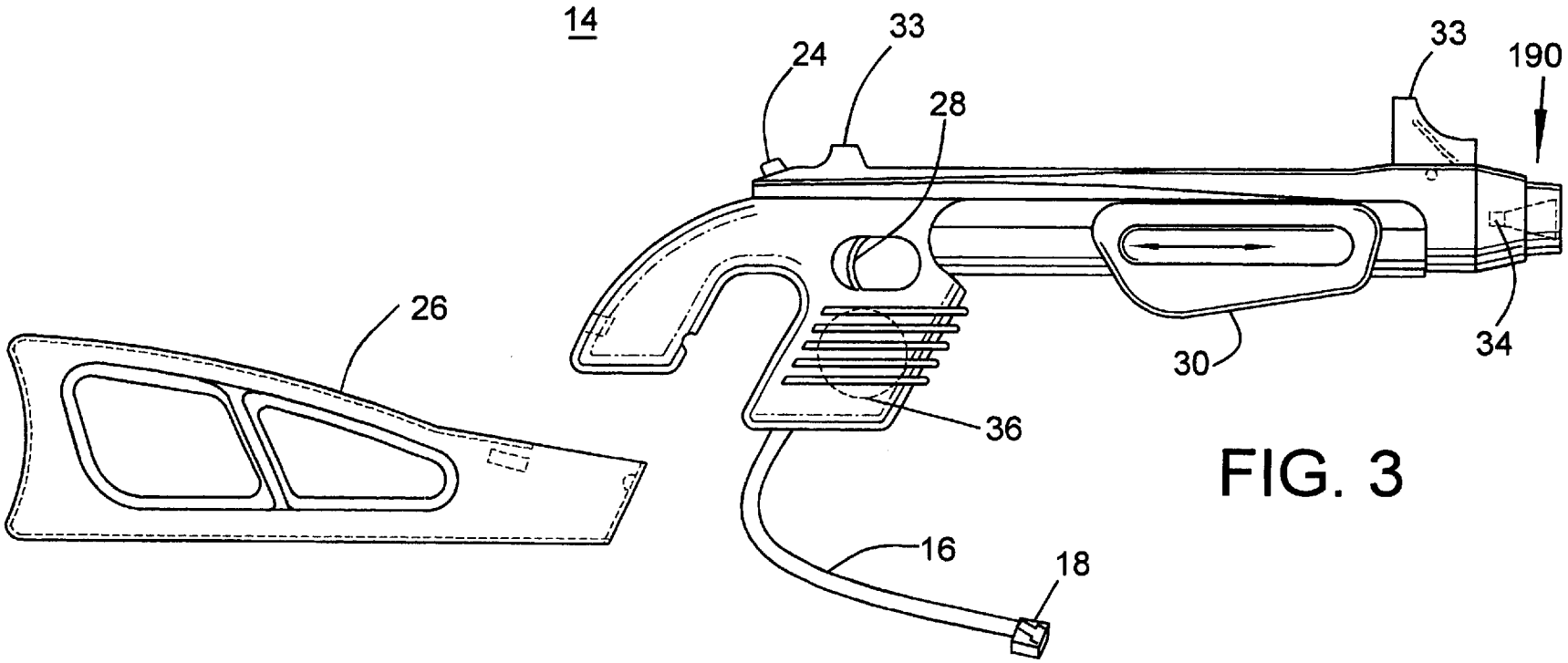
FIG. 3 is a side elevation view of the toy gun unit depicted in FIG. 1.

FIGS. 1 through 14 illustrate a preferred embodiment of a target shooting toy 10 (FIG. 1) incorporating the invention which includes an image projector unit, or simply "image projector", 12 (FIG. 2) and a user movable device or toy gun unit, or simply "toy gun", 14 (FIG. 3). Referring to FIG. 2, the image projector 12 includes a base 22, a rotatable turret 38 mounted to the base 22 and a rotatable lamp housing or "projector" 40 mounted to the turret 38 by support arms 42 and 44. A target shooting toy as substantially illustrated in FIGS. 1–14 is currently being sold by Toymax Inc. under the trademark Arcadia™ electronic skeet shoot.

Figure 1:
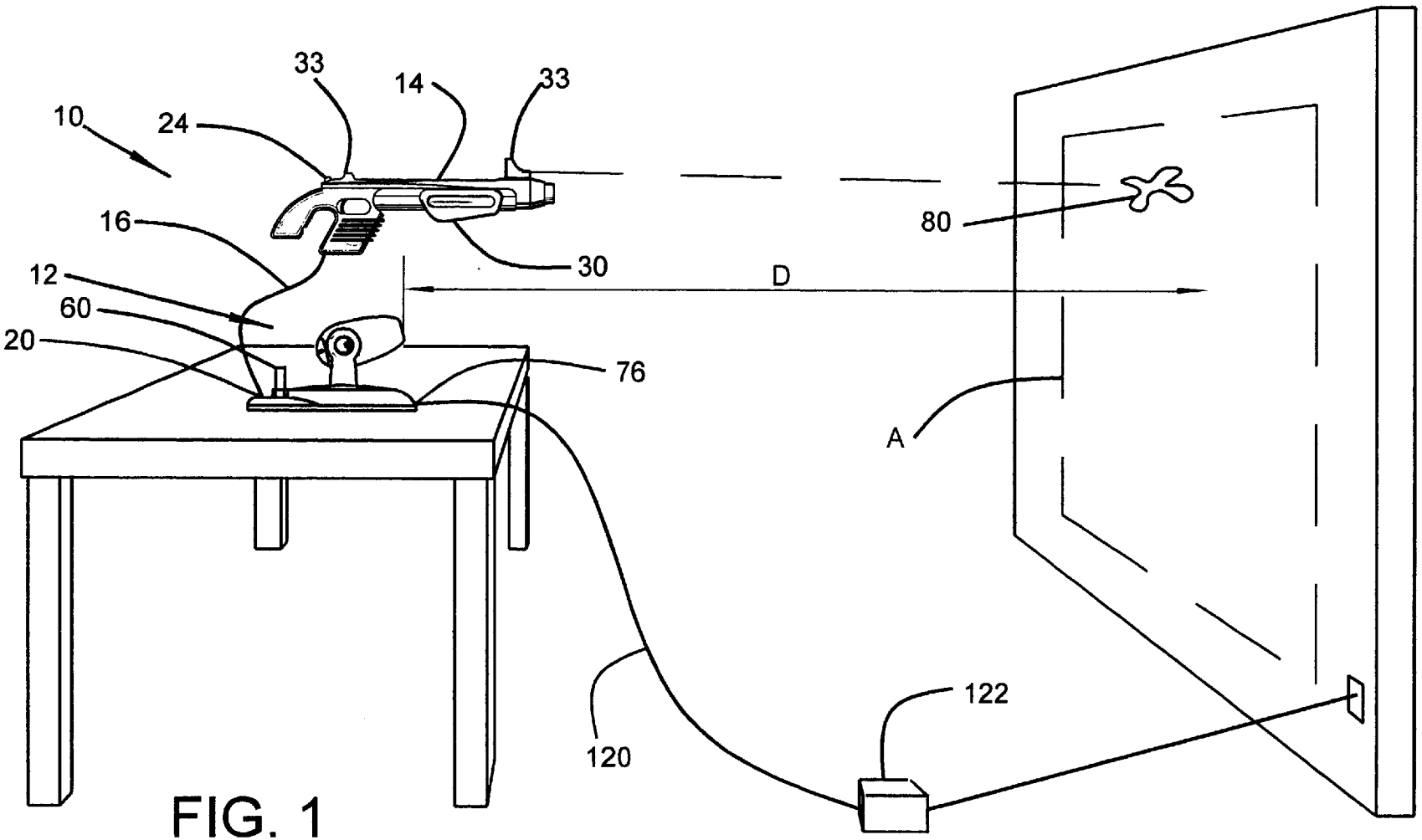
FIG. 1 is a side elevation of a projected image target shooting toy according to the invention which includes an image projector unit that projects an image of a target on a display surface, a toy gun unit coupled to the image projector unit which can be aimed at the target image, and optics and electronics which detect a hit of the target image.

Referring in particular to FIGS. 1 and 3, the toy gun 14 is coupled to the image projector 12 by a cable 16 which is fixed to the toy gun 14 and has a connector 18 at its free end which connects to a mating connector 20 (FIG. 2) in a base 22 of the image projector 12. The cable 16 includes a number of electrical conductors for power and various signals that must be transmitted therethrough, as discussed below. The connectors 18 and 20 are mating parts of a modular telephone connector. However, other connectors may be used. The image projector 12 includes a second connector 20 for coupling an optional second toy gun 14 thereto. The toy gun 14 is discussed in more detail below.

An electronics cartridge or module 60 (FIG. 4) is removably received in a slot 62 of the image projector base 22 and controls various functions of the target shooting toy 10, as described below. The cartridge 60 preferably holds the second electrical circuit referred to above. An image holder or module 78 (FIG. 2) is removably received in a slot 94 in the projector 40 of the image projector 12 and includes images optically stored on an optical medium that the projector 40 projects onto a display surface A (FIG. 1).

Image Projector 12 and Image Holder 78

Figure 4:
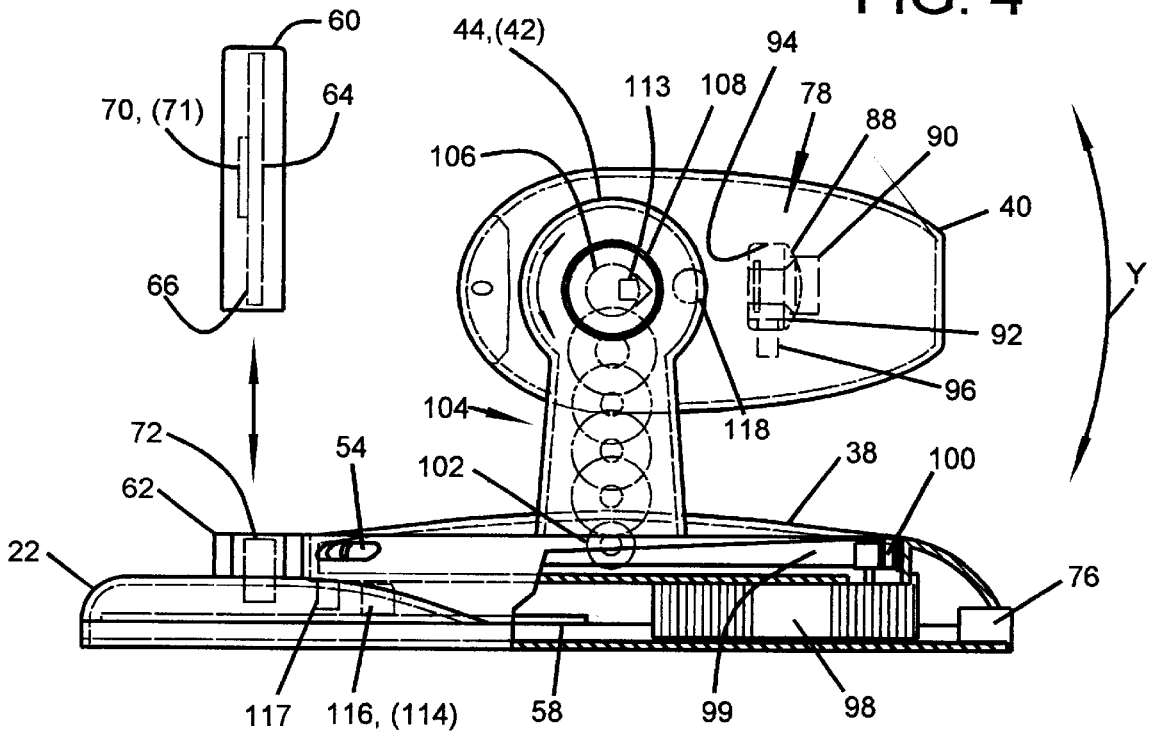
FIG. 4 is a side elevation view of the image projector unit depicted in FIGS. 1 and 2 showing an electronics cartridge disconnected from the image projector unit.

Referring to FIGS. 2 and 4, the turret 38 is journalled in the base 22 for rotational movement thereof in the direction of arrow "X", and the projector 40 is journalled in trunnion fashion to the arms 42 and 44 for rotational movement in the direction of arrow "Y". As a result, the projector 40 is mounted for movement in two directions which, as described below, produces motion of a project image 80 on the display surface A, in two axes, i.e., the x and y axes of the Cartesian coordinate system.

Referring to FIG. 2, the image holder 78, which is removably received in the slot 94 in the projector 40, preferably holds an optical medium 87, preferably a photographic film transparency, on which is optically stored at least first and second optically-stored images 84 and 86. The optically-stored images 84, 86 are spaced apart so as to be independently illuminable by a light source or sources in the projector 40. In the preferred embodiment, projection lamps 118, 119 (FIG. 7) are provided and controlled to independently illuminate each of the images 84 and 86. The image holder 78 has an aperture 92 therein aligned with each optically-stored image. When the image holder 78 is properly seated in slot 94, each optically-stored image is aligned with a respective a respective lamp 118, 119 to transmit light through the respective optically-stored image and project a light beam from the projector 40 defining an image 80, 82 (FIG. 2) corresponding to the respective optically-stored image 84, 86 on the display surface A (FIG. 1, which shows display of only one image 80).

The images may, for example, represent the state of a target, particularly a flying or mobile target, before and after a hit is registered. For a flying target, one image shows the target flying and the other shows the same target falling, or one image shows the target in tact and the other shows it broken-up in some fashion. In one duck shooting embodiment, one image 80 is that of a duck (FIG. 1) in a flying state and the other is that of the same duck (not shown) in a falling state after having been hit.

The image holder 78 includes configuration or structure for ensuring that the image holder 78 is correctly inserted and seated in slot 94 with the optically-stored images 84, 86 aligned with a respective lamp 118, 119. For example, the image holder 78 may have a distinctly shaped profile 88, a stop member 90, and a notch 92. The shaped profile 88, closely mates with a similarly profile in the slot 94 in the projector 40. The stop member 90 A substantially prevents the image holder 78 from being incorrectly inserted in the projector 40. The notch 92 cooperates with a mating detent 96 (e.g., biased pin, shaped leaf spring and the like) that is mounted in the interior of the projector 40 for properly seating the image holder 78 therein. The notch 92 and detent 96 arrangement also ensures retention of the image holder 78 correctly positioned in the slot 94 until selective removal by a user.

Illumination of the lamps 118, 119 is controlled by a programmed processor 70 (FIG. 6) in the electronics cartridge 60. Drive circuits 97 (FIG. 7) for the lamps 118, 119 are mounted on a printed circuit board 58 in the base 22 of the image projector 12. The processor 70 also controls other functions, as described below.

Images may be provided for projection in other ways. For example, the images may be electronically stored in a memory, and video processing circuitry may be provided for causing an optical image to be displayed on a display such as an LCD. The image appearing on the display may then be projected to display surface such as surface A. Electronics for electronically storing optical images and for displaying the image on a display device such as, an LCD are known in the art and will not be described herein. Also, projecting an image from a display device such as an LCD to a display surface such as a wall or screen is also known in the art and will not be described herein.

Figure 5:
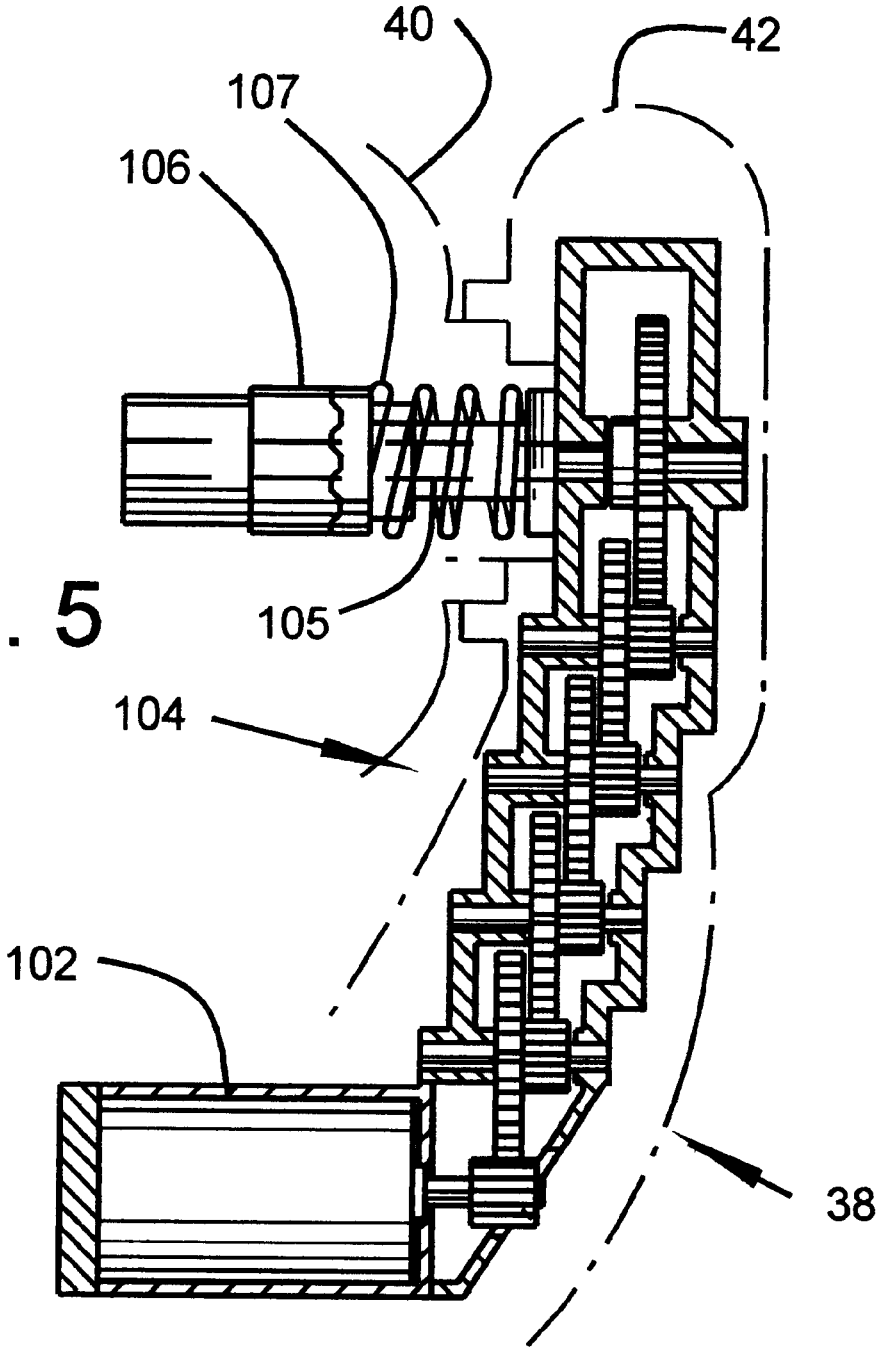
FIG. 5 is an elevation view in an enlarged scale of a support arm of the image projector unit, this view being partly in section and being taken along line 5—5 of FIG. 2 to show a gear train coupled to a motor.
Figure 6:
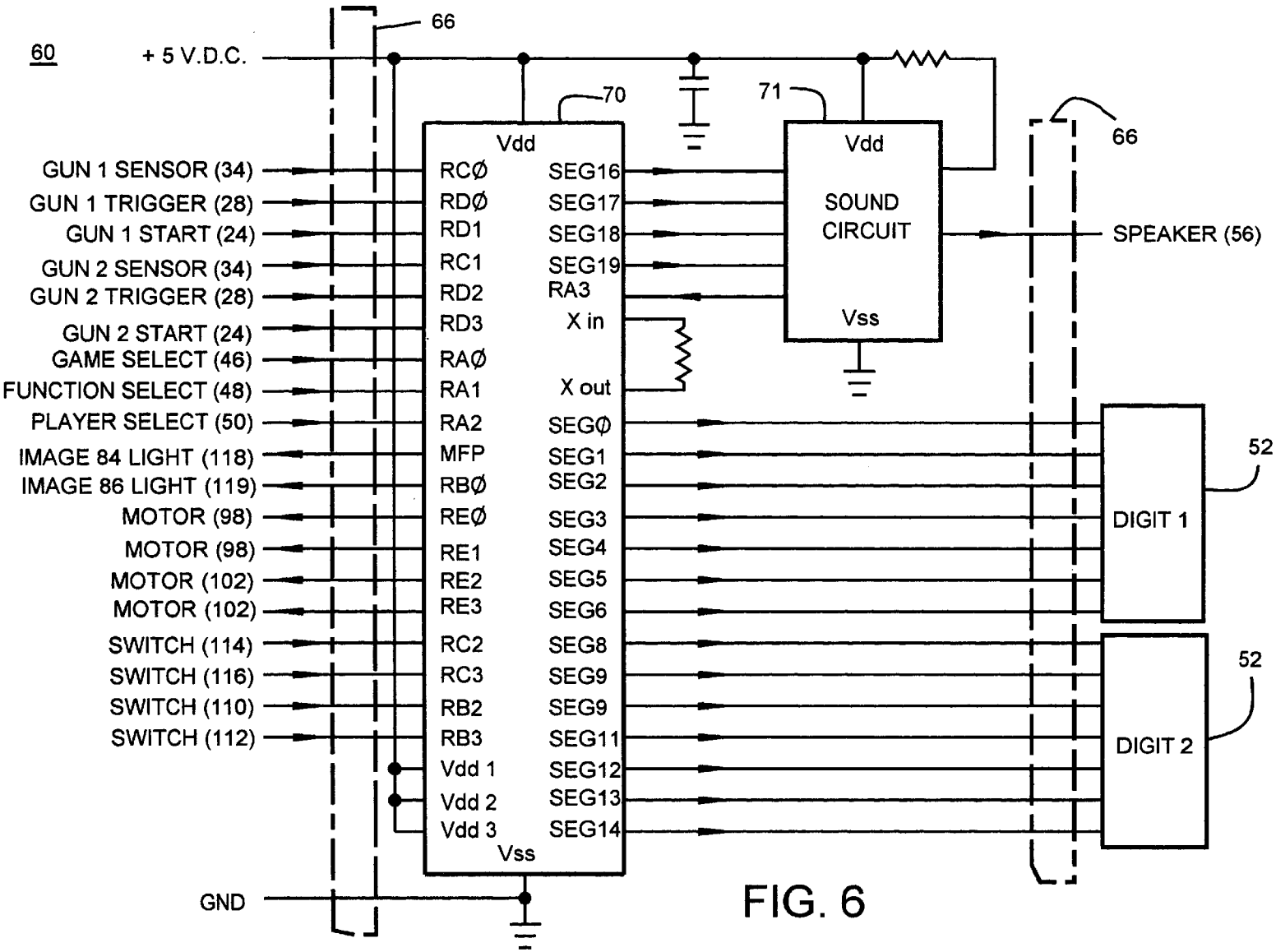
FIG. 6 is a schematic circuit diagram of electrical circuitry in the cartridge depicted in FIGS. 1, 2 and 4 which is removably coupled to the image projector unit.

Referring to FIG. 4, movement of the turret 38 in the direction of arrow "X" is powered by a first reversible electric motor 98 that is fastened to the base 22. An output pinion gear (not shown) of the motor meshes with and drives a gear segment 100 that is formed along or attached to a selected portion of a base portion 99 of the turret 38. The support arms 42 and 44 are mounted to and rotate with the base portion 99, so that actuating the motor 98 rotates the base portion 99 and with it the projector 40. Referring to FIGS. 4 and 5, movement of the projector 40, in the direction of arrow "Y", is powered by a reversible electric motor 102, and a gear train 104 that is carried by and with the turret 38. The processor 70 (FIG. 6) in the electronics cartridge 60 controls the electric motors 98, 102 through respective drive circuits 103 mounted on a printed circuit board 58 in the base 22.

The gear train 104 (FIGS. 4 and 5) is housed in the interior of the support arm 42. The output shaft 105 (FIG. 5) of the gear train 104 is preferably coupled to the projector 40 by way of a clutch 106, which allows slippage to prevent damage to the gear train and motor in the event of mishandling. The clutch 106 is preferably a tooth type for positively and accurately maintaining relative positions of the clutch halves during normal operation thereof. The engagement or meshing of the teeth is preferably maintained by a biasing spring 107 (FIG. 5). This arrangement provides the gear train 104 and motor 102 with overload protection that allows the clutch halves to slip when the projector 40 is mishandling or misadjusted. This overload arrangement also functions as part of a manually actuated adjustment mechanism, described below, which allows a user to initially manually aim the projector 40 at a selected point along the path of arrow "Y" and in incremental angles.

In the preferred embodiment, an incremental angle in the vicinity of 30 degrees satisfies the initial adjustment needs of the target shooting toy 10. It has also been found that the total powered movement of the projector in the "Y" direction by the gear train 104 and motor 102 combination should have an included angle within the range of 38 and 48 degrees. Preferably the range of powered movement provides an overall movement of 2.13 m (7.0 ft.) in the "Y" direction when the projection assembly 12 is positioned between 2.4–3.0 m (8–10 ft) from the display surface A.

In addition to the initial or mechanical adjustment mechanism which includes the clutch 106, an electromechanical adjustment is also preferably provided which includes an angle select knob 108 (FIG. 2) that is positioned in support arm 44. The angle adjustment knob 108 allows the user to more finely tune or adjust the position of the projected target on the display surface A. It has been found that incremental positioning steps in the vicinity of 15 degrees for the angle select knob 108 provides satisfactory results. The movement of the angle select knob 108 moves the relative positions of an up limit sensor or switch 110 (FIG. 7) and a down limit sensor or switch 112 (FIG. 7) housed therein. The up limit switch 110 and the down limit switch 112 control the extreme or ultimate extents, along the "Y" path, for electrically reversing the motor 102. In normal operation, the up-limit switch 110 and the down-limit switch 112 only control the limits of the full range of movement of the projected image. The actual instantaneous movement or mechanical positioning parameters of the optical target image in the "Y" direction are determined by the processor 70 (FIG. 6) in the cartridge 60. The angle select knob 108 includes an indicator 113, such as an arrow, for providing a visual or sensory indication of its relative position.

The full range of movement of the turret 38 is controlled by a left limit switch 114 (FIGS. 2, 4 and 7) and a right limit switch 116 that are actuated by a lug 117 selectively located on the turret 38. However the instantaneous position of the turret 38 along the "X" path is determined by the processor 70 in the cartridge 60. The resultant movement or lack thereof of the displayed target image on the display surface A is determined by the processor 70.

The motors 98 and 102 for driving the turret 38 and projector 40, respectively, are preferably of DC motors to facilitate reversal thereof. Further, a DC motor also allows for varying the speed of the motor 98 and/or 102, which in turn may selectively move the target at varying rates across the display surface A as appropriate for the type of game being played. The combination of the variable speed control of the movement of the target image and selectable positioning parameters in either the "X" and/or "Y" direction, as provided by the replaceable cartridge 60, challenge the skills of the user. Circuitry for providing variable speed control of the motors is known in the art and will not be described herein.

In addition to the unpredictable movement described above, the processor 70 (FIG. 6) is preferably preprogrammed for controlling energization of the lamps 118, 119. Programmed control of the lamps 118, 119 allows target images to be either simultaneously displayed for prolonged periods as the turret 38 and projector 40 move along their respective "X" and "Y" paths, or are randomly displayed for short intervals or periods during movement or lack thereof of the turret 38 and/or projector 40. The short periods of target display may be considered a stealth mode of operation, meaning that the projector 40 is moved while the lamps 118, 119 are off, then either or both lamps are turned on to project one or more images to seemingly unpredictable locations for brief periods.

In order to reduce the number of or eliminate false hits from extraneous light, and to detect hits in lit (dimly) play areas, the light projected by the projector 40 is coded or modulated. In the preferred embodiment, it has been found effective to modulate the current to either or both of the lamps 118, 119 at a frequency of between 30 and 40 Hz and to program the processor 70 to detect modulated signals in the range provided by a light detector 34 (FIGS. 3 and 10) mounted in the toy guns 14. A frequency in the range of 30–40 Hz is high enough so that humans do not notice flicker in an image modulated in that frequency range, and yet low enough that the light detection circuitry does not respond to 50–60 Hz modulated light produced by conventional room lighting such as fluorescent lighting.

The image projector 12 is formed of thermoplastic material making it light-weight and compact, having a small foot print of only 25.4 cm long×22.86 cm wide×14 cm high (10 in.×9 in.×5.5 in). Its compactness and light weight allow it to be easily transported and/or stored thereby allowing its use at a selected site as and when desired.

Toy Gun 14

Referring to FIG. 3, the toy gun 14 includes a trigger 28 and the light detector 34, and preferably also includes a start button 24, a detachable stock extension 26, a pump action reload or trigger cocking mechanism 30, a speaker 32 and a sight 33. The connector 18 on the cable 16 plugs into the connector 20 (FIG. 2) on the image projector base 22, as discussed above.

Figure 11:
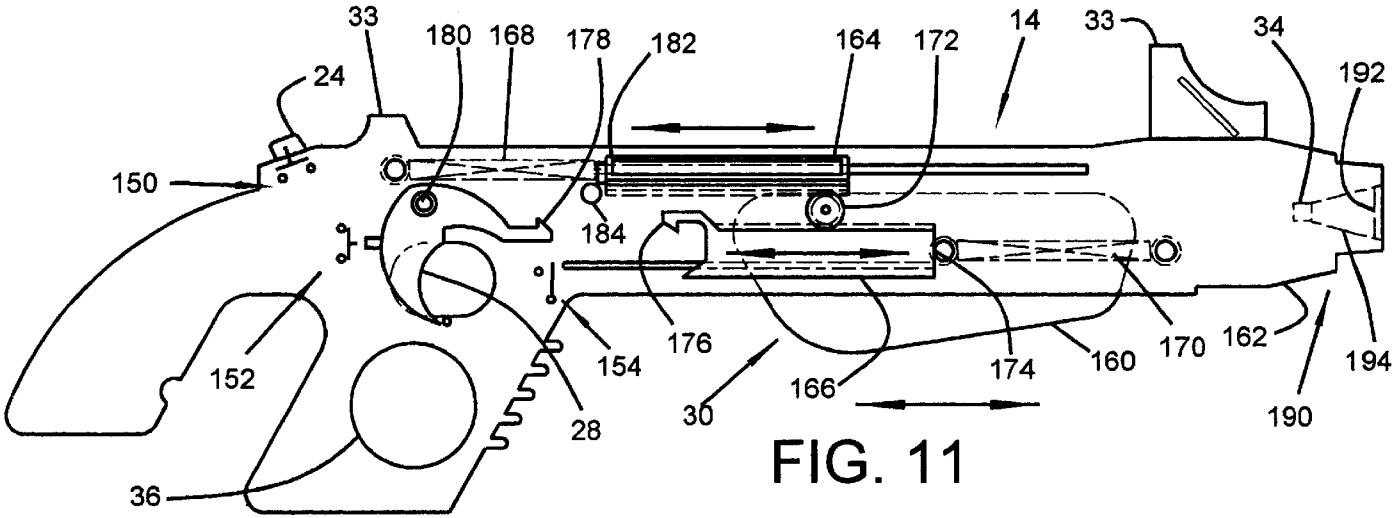
FIG. 11 is side view, largely schematic, of the toy gun illustrating operation of a pump action loading mechanism.

Referring to FIG. 11, the pump action mechanism 30 includes a handle 160 slidably mounted to the gun barrel 162 for reciprocating motion therealong. Upper and lower rack gear members 164, 166 are mounted within the gun barrel 162 on tracks or guides for reciprocating movement in opposite directions. A pinion gear 172 rotatably mounted between the rack gear members 164, 166 meshes with the gears of each rack 164, 166 so they move in opposite directions upon rotation of the pinion gear or forced by movement of one of the rack gear members. A coil spring 168 coupled to the rack gear member 166 urges it towards the trigger 28. A lug 174 extends from the handle 160 into the barrel 162 through in elongated slot (not shown) and engages the rack gear member 166 so that the handle 166 and the rack gear member 166 move together towards the trigger 28. Another coil spring 170 is coupled to the lug 174 and urges the handle 160 away from the trigger 28. The end of the rack gear member 166 closest to the trigger 28 has a hook 176 shaped to engage a hook 178 attached to the trigger within the toy gun 14. FIG. 11 illustrates the pump action mechanism 30 in an uncocked condition of the trigger 28, with the handle 30 in its most forward, home position.

The pump action mechanism operates as follows. The handle 160 is grasped and slid towards the trigger 28 against the action of the spring 170, which causes the lower rack gear member 166 to move towards the trigger 28 until the hooks 176, 178 engage, which holds the lower rack gear member next to the trigger 28. The trigger 28 is rotatably mounted on a post 180 biased counter-clockwise by a trigger spring (not shown) mounted on the post 180. The hooks 176, 178 have camming surfaces which cause the trigger 28 to rotate clockwise against the action of the trigger spring until the hooks 176, 178 engage. The trigger spring urges the trigger counter-clockwise to maintain the hooks engaged and thereby cock the trigger. In this configuration, the lower rack gear member 166 closes a leaf spring switch 154.

At the same time, that the lower rack gear member 166 moves towards the trigger 28, the upper rack gear member 164 moves in the opposite direction away from the trigger against the action of the spring 168 and is held there by its engagement with the lower rack gear member 166 via the pinion gear 172.

While the trigger 28 is cocked, pressing it rotates the trigger clockwise to activate the trigger switch 152 and release the upper rack gear member 164, which is pulled towards the trigger by its spring 170. At the same time the lower rack gear member 166 is moved away from the trigger under action of the pinion gear 172 and the rack gears on the rack gear members 164, 166.

The pump action mechanism thus performs a reload function in that the switch 154 must be closed again in order to fire again and a trigger cocking function to hold the trigger cocked, as described above. (Also, as described below, closing switch 154 causes the gun to emit a gun cocking sound, and closing the trigger switch 152 while the switch 154 is closed causes the toy gun 14 to emit a gun firing sound and to provide a signal to the processor 70.) In addition, the pump action mechanism performs a simulated recoil function. A stop 184 is positioned in the path of travel of upper rack member 164 at a point where the coil spring still exerts substantial force on the upper rack member 164. The upper rack gear member 164 has attached thereto one or more weights 182. Movement of the weighted upper rack gear member 164 after a trigger squeeze towards the trigger 28 under the action of spring 168 is stopped by the stop 184 while the spring 168 has considerable force so that the weighted rack gear member 164 impacts the stop forcefully to simulate a recoil.

While the light detector 34 has been shown mounted to the toy gun 14, it may be mounted in the image projector 12, and a light transmitting conduit (e.g., a fiber optic cable) coupled from the toy gun 14 to the light detector 34. The toy gun 14 includes an optics assembly 190 (FIG. 11) including a lens 192 and an opaque conical member 194 which spaces the light detector 34 a suitable distance from the lens 92 while transitioning the larger diameter lens to the smaller diameter light detector 34 (or a light transmitting cable where one is used).

The toy gun 14 receives power from the image projector 12 via the cable 16. However, if desired, a battery may be provided in the toy gun 14. Also, while the toy gun 14 in the preferred embodiment is tethered to the image projector 12 by the cable 16 through which signals are transmitted by the light detector 34 and the switches associated with the start button 24, the trigger 26 and the pump action reload mechanism 30, signals from those devices can be wirelessly communicated to the image projector 14 (e.g., by ultrasonic, RF or infrared). Those and other wireless communication systems suitable for use here are known.

Electronics

The base 22 (FIGS. 2 and 4) includes: first (PLAYER), second (GAME) and third (FUNCTION) push buttons 46, 48 and 50 respectively coupled to switches 46*a*, 48*a* and 50*a* (FIG. 7), a display 52, a power switch 54 and a speaker 56. The base 22 houses the printed circuit board 58 (FIG. 4) to which is mounted the circuitry represented in FIG. 7 and some of the circuitry represented in FIGS. 8 and 9. The removable electronics cartridge 60 contains the circuitry represented in FIG. 6, including the processor 70 and a sound circuit 71, mounted a printed circuit board 64, and is removably mounted to the base 22 to removably couple the programmed processor 70 (or computer) to the circuitry represented in FIG. 7. The cartridge slot 62 in the image projector base 22 provides access to a connector 68 represented in FIG. 7. The printed circuit board 64 in the cartridge 60 has a male edge connector portion 66 that mates with the connector 68 mounted on the printed circuit board 58 in the base and accessed by way of the slot 62. The circuitry in the base 22 (FIGS. 7–9) represents inputs and outputs of the programmed processor 70.

The programmed processor 70 includes memory in which are stored the motion parameters, projection parameters, lamp illumination parameters, sound trigger parameters, display sequence parameters, game modes, options, and other parameters and attributes which define and/or control game play and operation of the toy 10. The sound circuit 71 has memory in which are stored signals needed to generate various sounds played by the speaker 56. The programmed processor 70 also includes circuitry which determines hits, as described herein.

One non-limiting example of a programmed processor 70 is a W741E250 or the like, and one non-limiting example of a sound circuit 71 is a W5281 and the like.

The cartridge slot 62 preferably includes an interlock switch 72 (FIGS. 2, 4 and 9) for detecting the presence of the cartridge 60 seated therein and for controlling the application of power thereto. One non-limiting example of the interlock switch 72 is a microswitch positioned to be actuated by a cam 73 (FIG. 2) pivotably mounted along the edge of the slot 62. Inserting the cartridge into the slot pivots the cam which actuates the microswitch. The cartridge 60 and the slot 62 also preferably include keying projections and slots 74 (FIG. 2) for ensuring proper orientation of the cartridge when it is inserted into the slot Referring to FIGS. 1 and 9, the target shooting toy 10 can be powered by a low voltage power supply such as 9 V.A.C., which may be obtained from a conventional A.C. line step-down transformer (not shown, but within transformer unit 122 in FIG. 1) integrated with a line cord or plug for connection to a household A.C. line outlet. The transformer has a low voltage A.C. output 120 terminating in a connector (not shown) which is removably connected with a connector 76 (FIGS. 1, 2 and 4) in the base 22. The on-off power switch 54 couples the low voltage A.C. to the circuitry in the image projector 12.

Figure 7:
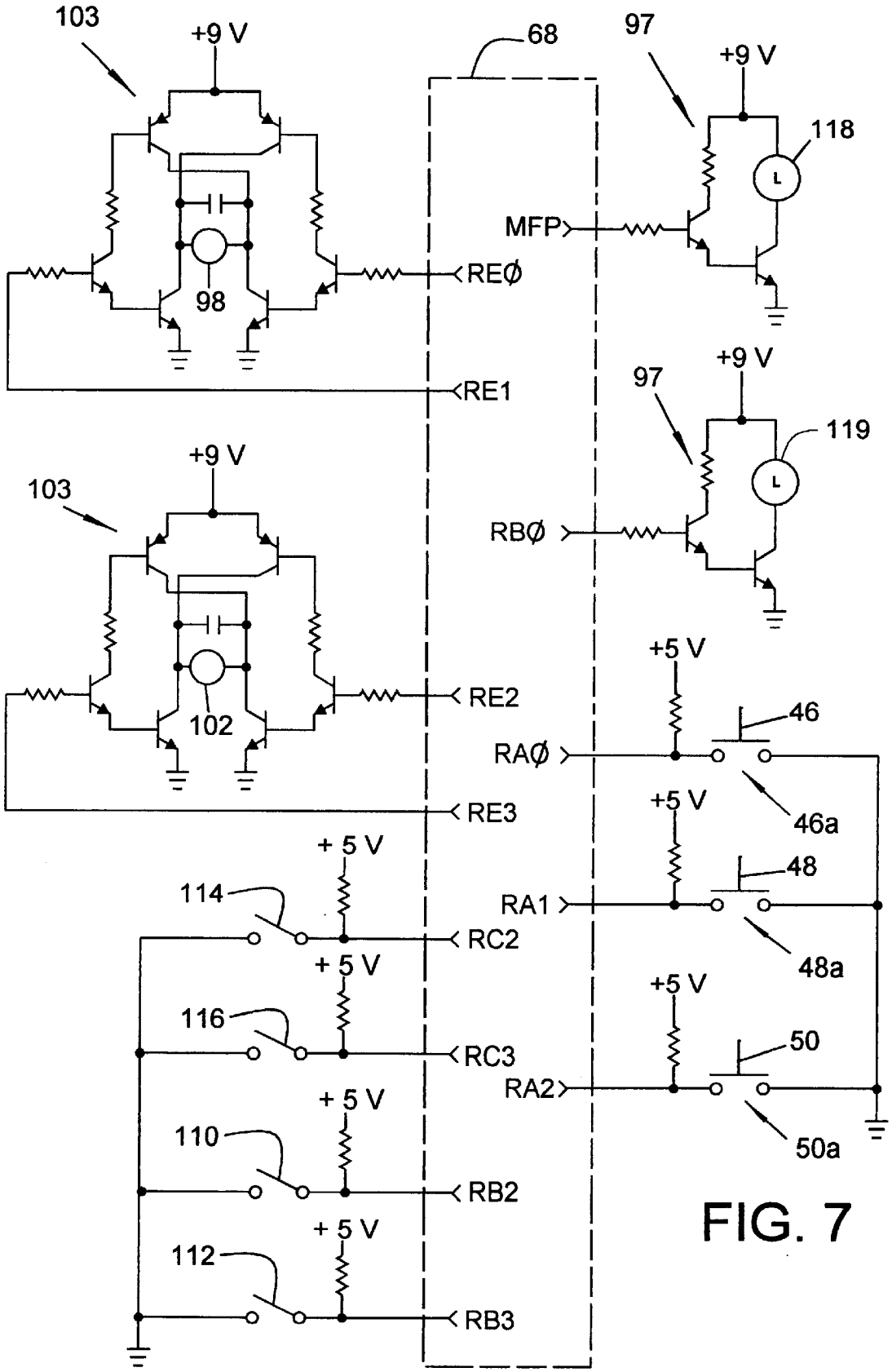
FIGS. 7–9 are schematic circuit diagrams of the electrical circuitry in the image projector unit.
Figure 8:
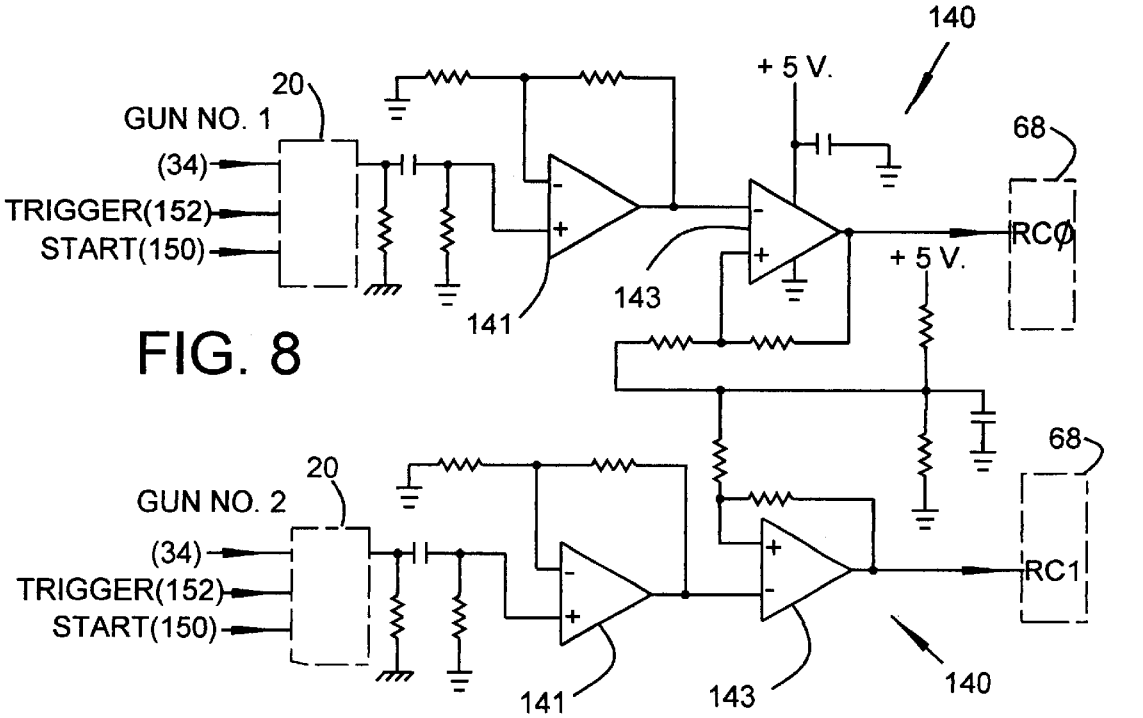
Figure 9:
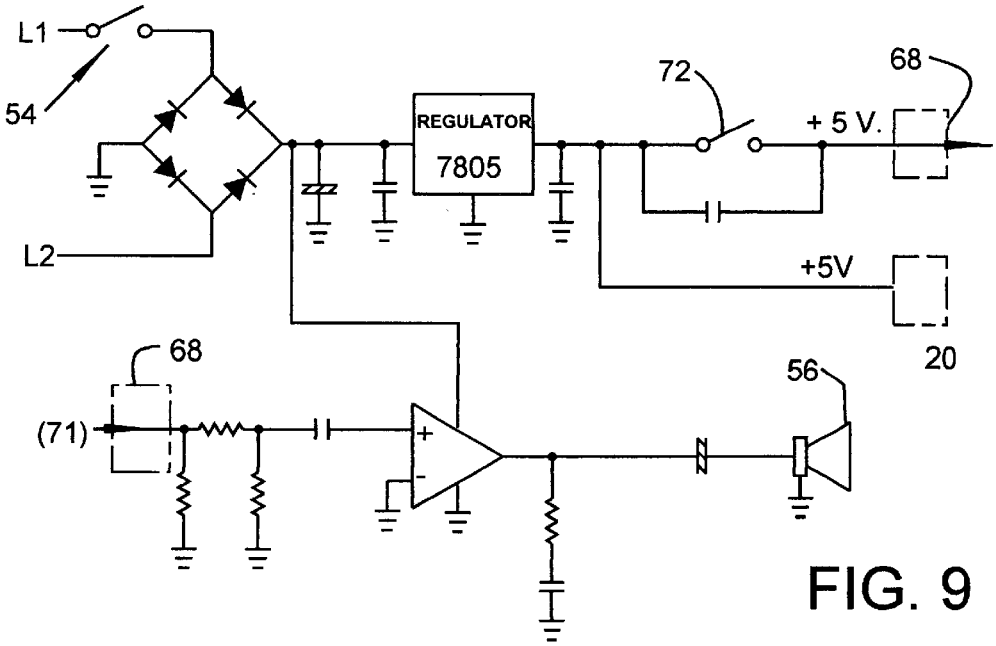

Referring to FIG. 7, the connector 68 accessible through slot 62 (FIGS. 2 and 4) interconnects the circuitry (FIG. 6) in the cartridge 60 and the circuitry (FIGS. 7–9) in the image projector base 22. The connectors 18 (FIG. 10) on each toy gun 14 and the connectors 20 on the image projector base 22 connect respective terminals of the start switch 150 and the trigger switch 152 in the gun with connector 68 and the output of the light detector 34 with the respective amplifying and trigger circuit 140 (FIG. 8) in the image projector base 22. The connectors 18 and 20 also connect 5 V from the image projector base 22 to the circuitry in the toy gun 14.

The light detectors 34 (FIGS. 3 and 10) in the toy guns 14 in response to receiving modulated light are capable of providing a modulated electrical signal having a frequency related to the frequency of modulation of the modulated light (e.g., 30–40 Hz as discussed above). The light detector 34 is conventional and detects visible light and provides electrical output signals in response thereto. As discussed above, light modulated in the range of 30–40 Hz has been found effective for operation of the target shooting toy 10. Therefore, the light detector 34 is selected to detect modulation of visible light at least in that frequency range. The light detector 34 may be a conventional photo transistor or photo diode. The signals output by the light detector 34 are coupled to an amplifier and trigger circuit 140 (FIG. 8) which includes an amplifier stage 141 and a trigger stage 143 which requires a minimum signal level to provide the amplified signals to connector 68 for coupling to the processor 70 (FIG. 7) as the Gun 1 and Gun 2 sensor inputs RC0 and RC1, respectively. The processor 70 is programmed to count pulses in the signals on inputs RC0 and RC1 for a predetermined time to determine whether the signals are in the 30–40 Hz range. When a signal on RC0 or RC1 is detected to be within the 30–40 Hz range, the processor 70 determines that a hit has occurred. In response thereto, the processor 70 performs the game functions described herein.

Figure 10:
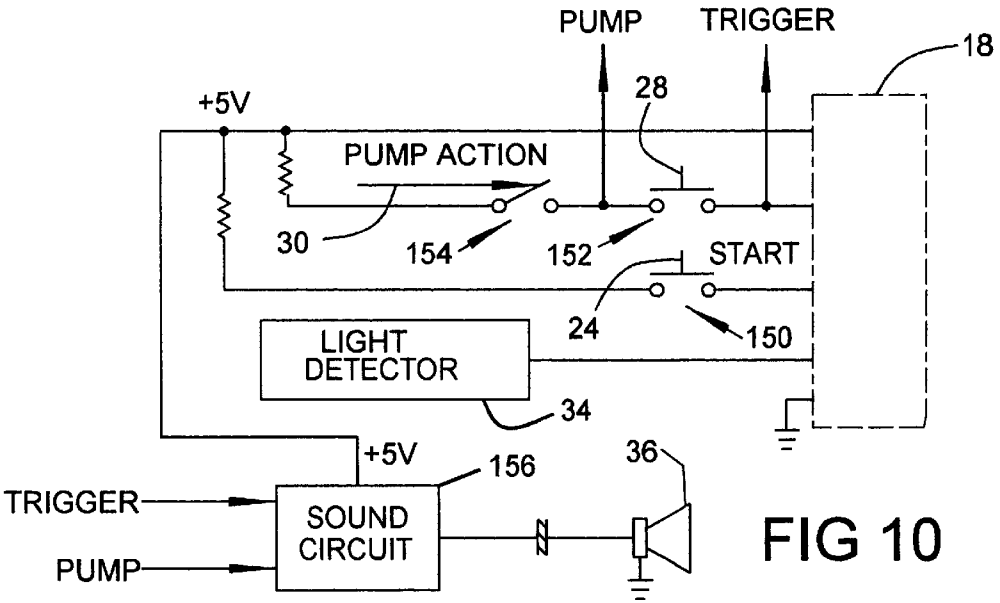
FIG. 10 is a block and schematic circuit diagram of the electrical circuitry in the toy gun unit.

Referring to FIG. 10, the circuitry in the toy gun 12 also includes a start switch 150 actuated by the start button 24 (FIG. 3), a trigger switch 152 actuated by the trigger 28 (FIG. 3), a trigger cocked switch 154 actuated by the pump action reload mechanism 30, a sound generating circuit 156 and the speaker 36. Pressing the start button 24 causes the start switch 150 to supply a pulse to connector 18 which is coupled to the RD1 (or RD3) of the processor 70 by connector 20 and connectors 66, 68. Actuating the pump mechanism 30 towards, the trigger 28 cocks the trigger for firing, as described above, and provides a pulse to the sound generating circuit 156. The trigger cocked switch 154 and the trigger switch 152 are connected in series with 5V, so that pressing the trigger 28 causes the trigger switch 152 to supply a TRIGGER pulse to connector 18 and the sound generating circuit 156 only when the trigger cocked switch 154 is held closed by the pump action reload mechanism 30. The TRIGGER pulse generated when the trigger switch 152 is closed is coupled to the RD0 (or RD2) input of the processor 70 by connector 20 and connectors 66, 68,. The processor 711 determines whether light detected by a light detector 34 is from a lamp 118, 119 when a TRIGGER pulse is generated. Pressing the trigger 28 releases the pump action reload mechanism 30 and opens the trigger cocked switch 154 so that while the trigger cocked switch 154 is open, further trigger squeezes do not produce further TRIGGER pulses.

The sound generating circuit 156 (FIG. 10) in the toy guns 12 generates a trigger cocking sound signal in response to the PUMP pulse and a gun firing sound signal in response to the TRIGGER pulse. The speaker 32 sounds a gun cocking sound in response to the gun cocking sound signal and a gun firing sound in response to the gun firing sound signal provided by the sound generating circuit 156.

The processor 70 (FIG. 6) also receives function select switch 48 activations on port RA1 and player select switch 50 activations on port RA2, and activations of the limit switches 112, 114, 116 and 118 on ports RC2, RC3, RB2 and RB3, respectively, from the image projector 12 via connectors 66 and 68. The processor 70 provides an output to each the lamp 118, 119 to control illumination and modulation thereof, drive signals to the motors 98 and 102 to energize them for driving the turret 38 and the projector 40 in forward and reverse directions, and outputs to the sound generating circuit 71. The sound generating circuit 71 also provides an input to the processor 70 on port RA3. Outputs SG0–SG12 control the display 52, which is conventional, e.g., LED or LCD.

Referring to FIG. 7, conventional motor drives circuits 103 are coupled to the connector 68 to receive the forward and reverse drive signals from the processor 70 (RE0–RE3), and conventional Darlington lamp drive circuits 97 are coupled to the connector 68 to receive signals from the processor 70 to switch the circuits at the modulated frequency.

The processor 70 can be programmed by one of ordinary skill to provide the functions described herein.

Operation

Referring in particular to FIG. 1, the image projector 12 is preferably placed on a flat surface such as a table or the like at a distance "D" between 2.4–3.0 m (8–10 ft) from a light colored display surface A, The display surface should be free of objects in a play area "A". In this example the display surface is in the neighborhood of 2.13 m (7.0 ft.) high by 2.13 m (7.0 ft.) wide. The size of the play area may be increased or decreased by increasing or decreasing distance "D" respectively. The transformer unit 122 is connected to the A.C. line and the low voltage output 120 is connected to connector 76 in the base 22. The connector 18 of toy gun's electrical cable 16 is connected to the connector 20 in the base 22.

Referring particularly to FIG. 2, the user initially inserts the cartridge 60 into the cartridge slot 62 followed by the insertion of the image module 78 into the projector 40 until it is fully seated. Referring now to FIGS. 2, 11, 13, and 14 the user now moves the power switch 54 to the ON position and then depresses the first push button 46 to select from the GAME options shown in FIG. 12. The GAME option codes (e.g. −1; −2 etc.) are sequentially displayed on the display 52 until a desired option is selected. Depressing the second push button 48 makes a selection from the FUNCTION options (FIG. 13). Each time the push button 48 is depressed the display 52 sequentially displays one of the FUNCTION codes (e.g. F1, F2 etc.). After the FUNCTION code is selected, the user depresses the third push button 50 for selecting from the PLAYER codes (e.g. P1; P2 etc.), shown in FIG. 14. A second toy gun 14 must be connected to the right connector 20 in the base 22 in order to select some of the player modes.

Selection of the GAME, FUNCTION and/or PLAYER options selects various parameters stored in processor 70. After the GAME, FUNCTION and/or PLAYER selections have been made, the user depresses the start button 24 on the toy gun 14. Prior to the actual staring of the game, the display 52 scrolls through the selected code for the GAME; FUNCTION and PLAYERS for review by the user. The period of play or "game end" is controlled by the processor 70. Non limiting examples for the period of play or "game end" are shown in FIG. 13.

After entering play and game selections, one or more players are ready to play. In the preferred embodiment, the toy gun 14 must be reloaded after each shot using the pump action reload mechanism 30. To play and attempt to hit a target image on the display surface A, a player aims the loaded toy gun 14 at the target 84 projected on the display surface using, the sight 33 on the gun 14. When the light detector 34 of the gun 14 is aligned to receive light reflected from the target image 80 on the display surface A, the processor 70 detects the reflected light and determines that a hit has occurred. In response to a hit determination, the processor 70 causes the lamp 118 illuminating the flying duck image at 84 in the image holder 78 to turn off and simultaneously causes the lamp 119 illuminating the falling duck image at 86 in the image holder 78 to turn on, which causes the image projector 12 to replace a flying duck image with a falling duck image. Also, after a hit, the projector 40 moves in the "Y" direction to project a vertically downwardly moving image to simulate a falling target. After a miss, a player must reload the gun 14 by using the pump action mechanism 30.

The preferred embodiment of the target shooting toy 10 includes a speaker 56 in the image projector base 22 and a sound circuit 71 to generate a simulated sound that corresponds to the status of the moving image 80 (e.g. duck, game, airplane, vehicle, etc.) that is projected on the display surface A. For example, a quacking sound may be made when a duck is flying normally, which is replaced by whistling sound when the duck is hit and falls.

The processor 70 in each cartridge 60 is preferably pre-programmed to generate motion, motion sequences, display of images 80, 82, sounds, etc. suitable for the targets in the corresponding image holder 78. Thus, the sounds may be customized to the specific targets, rather than being generic, and the motion, sequence, display etc. of the stored target images 84, 86 may be customized for the specific image. For example, a hit duck falls vertically, while a hit vehicle may continue to a limited extent its prior motion. Thus, image holders 78 and cartridges 60 are paired, and preferably bear indicia or are coded in some way to make the different cartridges and holders easily distinguishable and pairable. For example, the image holders and electronics cartridges may be color coded or may both have the name of the image (or suitable alpha-numeric coding) or a graphic representation of the image.

Using a second optional toy gun 14, the preferred embodiment of target shooting toy 10 of the present invention provides head to head competition between two players in the 2P mode (FIG. 14). In this mode, for example, the first player to hit a target wins, or the first player to hit a predetermined number of targets wins, or the player with the most hits at the end of a predetermined time wins.

Regardless of mode, scores may be checked by pressing button 50 until the player's as code appears and then reading the score associated therewith on the display 52.

Invention Not Limited To Specific Details

Directional terms such as "front", "back", "in", "out", "downward", "upper", "lower" and the like may have been used in the description. These terms are applicable to the embodiments shown and described in conjunction with the drawings. These terms are merely used for the purpose of description in connection with the drawings and do not necessarily apply to the position in which the present invention may be used. The specific embodiment illustrated in the drawings was chosen to show at least one preferred or best mode of the present invention, and not to limit the invention to the illustrated embodiment.

Also, while the invention has been described and illustrated in connection with preferred embodiments, many variations and modifications, as will be apparent to those of skill in the art, may be made without departing from the spirit and scope of the invention. The invention as set forth in the appended clams is thus not limited to the precise details of construction set forth above as such variations and modifications are intended to be included within the spirit and scope of the invention as set forth ill the claims.

What is claimed is:

1. In a target shooting toy which includes an image projector that projects a light beam therefrom that defines an image upon impinging a display surface, a drive system for the image projector which moves the light beam, a light detector which provides electrical signals in response to light received by the light detector, a hit determining electrical circuit coupled to the light detector which determines a hit from the electrical signals provided by the light detector when light received by the light detector is reflected from an image projected by the image projector on the display surface, and a user movable device which when pointed at the display surface directs light from the display surface to the light detector, the improvement comprising:

the drive system moving the light beam to project an image which moves in at least two coordinate axes and including at least one electrical motor coupled to the image projector, a first electrical circuit coupled to the at least one motor, a second electrical circuit having motion-defining parameters which define the motion of the light beam from the image projector, at least one connector having a first part carried by the image projector removably connectable to a second part connected to the second circuit to removably couple the second electrical circuit to the first electrical circuit such that the second electrical circuit can be removed and replaced by another second electrical circuit having motion-defining parameters different from those of the second electrical circuit, the first and second electrical circuits cooperating to supply electrical power to the at least one motor in accordance with the motion-defining parameters of the second electrical circuit.

2. The target shooting toy of claim 1 wherein the motion-defining parameters of the second electrical circuit define at least seemingly unpredictable motion of the light beam.

3. The target shooting toy of claim 1 wherein the motion-defining parameters of the second electrical circuit define varying speed motion of the light beam.

4. The target shooting toy of claim 1 wherein the second electrical circuit has first and second motion-defining parameters and responsive to the hit detecting circuit defines the motion of the light beam in accordance with the first motion-defining parameters when no hit is detected and in accordance with the second motion-defining parameters when a hit is detected.

5. The target shooting toy of claim 1, 2, 3 or 4 wherein the second electrical circuit includes a memory storing at least some of the motion-defining parameters and logic circuitry responsive to the memory which controls the first electrical circuit.

6. The target shooting toy of claim 1, 2, 3 or 4 wherein the second electrical circuit comprises a computer and memory storing at least some of the motion-defining parameters, the computer controlling the first electrical circuit.

7. The target shooting toy of claim 4 including a computer including the second electrical circuit and the hit determining circuit, and a memory storing at least some of the first and second motion-defining parameters.

8. The target shooting toy of claim 1 wherein the second electrical circuit has a plurality of sets of motion-defining parameters, and a selector coupled to the at least one connector, the second electrical circuit being responsive to the selector to select a set of motion-defining parameters.

9. The target shooting toy of claim 1 wherein the hit-determining circuit is coupled to the at least one connector and is removable as a unit with the second electrical circuit, the toy comprising a display coupled to the at least one connector, the second circuit controlling the display to display the number of hits determined by the hit determining circuit.

10. A target shooting toy including:

a) a projection assembly including a base portion, a turret, and a projector, the base portion being arrayed for housing a control circuit, the base portion further including at least one user actuable button, and a status display means;

b) the turret being arrayed for seating in an aperture of the base portion; the turret being selectively powered by a first powering means for pivotal movement thereof about a vertical axis of the base member, the turret further including a pair of spaced support arms c) the projector being mounted in trunnion fashion between a free end of each of the spaced support arms, the projector being arrayed for selective powered and pivotal movement about a horizontal axis of the turret by a second powering means, the projector further including a first projection unit and a second projection unit integrally mounted therein, the first projection unit having a first image associated therewith, the second projection unit having a second image associated therewith;

d) at least one toy gun assembly arrayed for providing at least one input signal to the microprocessor, the gun assembly further including a sighting means, a photocell, and a trigger, the photocell being adapted for responding only to the first image as and when the first image is projected on a display surface by the first projection unit;

e) a pre-programmed cartridge being removably connected to the control circuit, the pre-programmed cartridge housing a programmed processor and further including at least two distinct programs for controlling at least the pivotal movement of the turret, the pivotal movement of the projector, the illumination of the first projection unit and the illumination of the second projection unit, each of the distinct programs being user selectable by actuation of the actuable button, the status display means providing an indication of the distinct program selected; and wherein the first image being projected on the display surface by the actuation of the first projection unit in combination with the pivotal movement of the turret and the pivotal movement of the projector subsequent to an initiation of a shooting period, the sighting means providing a visual indication that the photocell is being aimed at the first image, the first projection unit being extinguished simultaneously with the illumination of the second projection unit only after the photocell is aligned with the first image and the trigger depressed, the second projection unit illuminating a second image thereby giving a distinct indication of a hit.

11. A toy target shooting simulator including:

a) a projection assembly being arrayed for illuminating and projecting at least a first image onto an image displaying surface;

b) a program cartridge being arrayed for removable insertion into the projection assembly, the program cartridge housing a programmed processor therein, the programmed processor being pre-programmed for controlling a timed period for illuminating and projecting the image; while simultaneously controlling an instantaneous X coordinate placement and an instantaneous Y coordinate placement of the illuminated image on the image displaying surface;

c) an image module being arrayed for removable insertion and seating in a mating receptacle of the projection assembly, the image module further including at least one view of the first image;

d) a simulated gun including a sighting means, an image sensing means, and a trigger, the gun being further arrayed for providing an input signal to the cartridge when and as the image sensing means is aligned with the first image on the image display surface while simultaneously actuating the trigger; and wherein the cartridge provides an output signal to an indication means that a simulated hit has occurred.

12. The target shooting toy of claim 11 wherein the program cartridge and its mating socket in the projection assembly further include a keying means for providing a preferred alignment and relationship of the program cartridge with the mating socket.

13. The target shooting toy of claim 11 wherein the programmed processor is arrayed and programmed for simultaneous connection to a second simulated gun for providing a competitive shooting simulation and the projection assembly further includes a pair of disconnect means for selective connection of each toy simulated gun thereto.

14. The target shooting toy of claim 11 wherein the projection assembly further includes a first sound means, the control circuit including a first sound output means for providing the first sound means with a sound associated with the first image contained in the image module that is inserted in the projection assembly and only while the first image is being illuminated.

15. The target shooting toy of claim 14 wherein the simulated gun further includes a second sound means and the control circuit including a second sound output means for providing a simulated sound of a firing gun when and as the trigger has been actuated.

* * * * *